US010450768B2

(12) United States Patent
Thompson

(10) Patent No.: US 10,450,768 B2
(45) Date of Patent: Oct. 22, 2019

(54) UNIVERSAL SWIMMING POOL LIGHT ADAPTER RING

(71) Applicant: Steven E Thompson, Palm Harbor, FL (US)

(72) Inventor: Steven E Thompson, Palm Harbor, FL (US)

( * ) Notice: Subject to any disclaimer, the term of this patent is extended or adjusted under 35 U.S.C. 154(b) by 0 days.

(21) Appl. No.: 15/932,008

(22) Filed: Jan. 24, 2018

(65) Prior Publication Data

US 2018/0223553 A1 Aug. 9, 2018

Related U.S. Application Data

(60) Provisional application No. 62/499,768, filed on Feb. 6, 2017.

(51) Int. Cl.

| | |
|---|---|
| ***F21V 31/00*** | (2006.01) |
| ***E04H 4/14*** | (2006.01) |
| ***F21V 23/06*** | (2006.01) |
| ***F21V 17/12*** | (2006.01) |
| *F21W 131/401* | (2006.01) |

(52) U.S. Cl.

CPC ..... *E04H 4/148* (2013.01); *F21V 17/12* (2013.01); *F21V 23/06* (2013.01); *F21V 31/005* (2013.01); *F21W 2131/401* (2013.01)

(58) Field of Classification Search

None

See application file for complete search history.

(56) References Cited

U.S. PATENT DOCUMENTS

| | | | | |
|---|---|---|---|---|
| 5,051,875 | A * | 9/1991 | Johnson | F21S 8/00 362/101 |
| 5,251,118 | A * | 10/1993 | Budnovitch | F21S 8/033 362/362 |
| 2007/0247837 | A1* | 10/2007 | Julia Vilarrasa | F21K 9/00 362/158 |
| 2008/0112157 | A1* | 5/2008 | Boothe | F21S 8/00 362/101 |
| 2009/0109675 | A1* | 4/2009 | Navarro Alvarez | A01K 63/06 362/249.02 |
| 2011/0089645 | A1* | 4/2011 | White | E04H 4/148 277/637 |
| 2011/0267834 | A1* | 11/2011 | Potucek | F21S 8/00 362/551 |

(Continued)

*Primary Examiner* — Elmito Breval

(57) ABSTRACT

A universal swimming pool light adapter ring consisting of a two-element interlocking adapter ring for retrofitting a swimming pool light into a swimming pool niche. The adapter ring has a two element face ring that interlocks and fastens around a swimming pool light cord, so that an existing swimming pool light does not need to be substantially removed or disassembled to facilitate installation. Further the adapter ring consists of an adjacent two-element mounting ring that utilizes a plurality of mounting screws to each respective element, which creates pressure points that secure the adapter firmly into the light niche to allow a fit into most standard light niches, including but not limited to, a sealed beam light niche. Two thread points on each opposing side on the adapter's face ring, as well as a mounting tab, allow multiple brands and sizes of swimming pool lights to be mechanically fastened, securely to the adapter.

11 Claims, 5 Drawing Sheets

(56) References Cited

U.S. PATENT DOCUMENTS

2012/0113654 A1* 5/2012 Dai ..... F21S 8/00
362/368
2014/0247599 A1* 9/2014 Yurich ..... F21S 8/061
362/304

* cited by examiner

UNIVERSAL SWIMMING POOL LIGHT ADAPTER RING

STATEMENT REGARDING FEDERALLY SPONSORED RESEARCH/DEVELOPMENT

Not Applicable.

BACKGROUND OF INVENTION

1. Field of the Invention

The invention relates to swimming pool water features generally and more specifically to swimming pool lighting fixtures used in swimming pools, spas, fountains, ponds and any other body of water in which a swimming pool light niche is employed in conjunction with a swimming pool light fixture.

2. Discussion of the Background

The use of underwater pool lighting is quite common in swimming pools, spas, fountains, ponds and other bodies, man-made or naturally controlled. The use of lighting can be for the purpose of safety, enabling a swimmer or swimmers to be readily visible underwater or just simply for the aesthetic appeal that either white or color lighting can give to a body of water. Most swimming pools and spas, whether commercial or residential, utilize at least one swimming pool light fixture mounted into a swimming pool light niche.

Traditionally, a swimming pool light fixture is mechanically fastened into a swimming pool light niche by a minimum of at least one screw, often also by a lower tab feature on the base, and on occasion, a second screw. The swimming pool light niche is a round encased, recessed cavity that usually extends several inches beyond the pool's wall, often one half to three quarters of the way up the wall in the deep end of the swimming pool. The edge of the niche is flush with the pool wall surface. A niche can be a part of any type of pool surface including but not limited to a concrete, fiberglass or vinyl pool surface. Swimming pool light fixtures mount vertically onto a swimming pool light niche in a manner that is flush or relatively flush to the pool surface.

As it comes to pass, many pool light niches have mounting screw tabs used for mounting the light fixture to the niche that by some means becomes damaged and can no longer be used to mechanically fasten the light onto the niche. Often, due to poor water chemistry, the tab will rust to a point where the screw is either broken or partially left in the threads of the tab, or the tab itself breaks off of the niche. In this case, some professional technicians will employ the use of what is known in the trade as a "light wedge" which can be used to reattach the light by means of applying pressure to the top of the fixture wedging against the lower tab. This method is sometimes effective, but often the light fixture can become dislodged from water activity or handling of the fixture while a swimmer is in the water. Certain brands and styles of niches do not even allow for this method. Many light wedges interrupt electrical bond continuity due to their construction is of non conduction materials.

Further, there are some niches, such as a sealed beam light niche, that are so different in size from other niches that certain brand light fixtures do not fit evenly in the niche and either won't mount in the niche or, if so, they appear to be set unevenly.

There are several styles and types of light ring adapters that are available to service the aforementioned conditions. There are internally mounted adapter rings that use three pressure points to secure the adapter into the niche but they do not fit well in some niches and do not account for the varying size of modern light fixtures, some of which do not cover the niches fully with their trim rings, thus leaving the niche partially visible after installation.

Another type of light ring adapter has a trim ring that covers the niche properly but doesn't fit in some niches due to its size and the mounting is done through three diagonal pressure screws that won't secure on other types of niches. Further, this type of light ring adapter cannot be mounted with the fixture in the niche and requires the removal of the fixture prior to installation and the re-installation of the fixture after installation of the adapter or the complete dissembling of the light fixture, which can lead to a host of unwanted consequences once dissembled. Many light fixtures that have been in water for years have a condition of which the electrical cord of the light becomes swollen from moisture and are very difficult or impossible to remove without damaging the fixtures and are even more difficult to then reinstall, or again, even impossible to reinstall.

Therefore, it is clear that there is a need for a universal swimming pool light adapter ring that can be mounted into any light niche, but still possesses a trim ring that can be mounted without the need of removing or dissembling an existing light fixture. The present invention is directed to this need.

After review of the background, summary and detailed description of the preferred embodiments, in conjunction with the drawings, specifications and claims, it should be apparent to anyone skilled in the field of Prior Art, that the present invention uniquely solves the need for, and method of securing, a light adapter ring that can be mounted into any light niche, but still possesses a trim ring that can be mounted without the need of removing an existing light fixture, on a swimming pool, spa or fountain.

SUMMARY

The present invention of a two-element universal swimming pool light adapter ring that may fit in a swimming pool light niche locking securely in place via the use of a plurality pressure points, that is able to be installed around the cord of an existing light fixture yet able to create a full trim ring utilizing the preferred embodiment of a two-element design that either mechanically fastens together or alternatively clips together by means of a locking tab and locking slot, and fully covers an existing niche and is further able to receive most size standard swimming pool lighting fixtures securely, solves this problem. Although there are several types of damage that can occur to a lighting niche that preclude various other light adapters from functioning properly, this present invention is able to be installed when other light adapters fail, due to several of the present invention's exemplary preferred embodiments such as a two-part trim ring to allow installation without removing the existing fixture. Another exemplary preferred embodiment is that the six pressure points allow for the light adapter ring to firmly be secured within a light niche of all standard models. A further exemplary preferred embodiment is that the light adapter ring allows for several mounting patterns to accommodate most models of lighting fixture.

Prior to this invention, no method existed to mechanically fasten a light adapter ring into any light niche, but still possess a trim ring that can be mounted without the need of removing an existing light fixture.

A complete understanding of the present invention may be obtained by examination of the accompanying drawings when considered in conjunction with the detailed description of the preferred embodiments.

BRIEF DESCRIPTION OF THE DRAWINGS

In the figures, similar reference numbers refer to similar parts typical through various figures unless noted otherwise. Numerals with letter characters in addition to numerals such as "101A" or "101B" the letter character designations for reference numerals indicates that two similar parts or elements are present in the same figure. Letter character designations for reference numerals may be omitted when it is intended that a reference numeral encompass all parts having the same reference numeral in all figures.

For a more complete understanding of the present invention, and for further details and advantages thereof, reference is now made to the following detailed description taken in conjunction with the following drawings, in which.

DETAILED DESCRIPTION OF THE PREFERRED EMBODIMENTS

Figure 1:
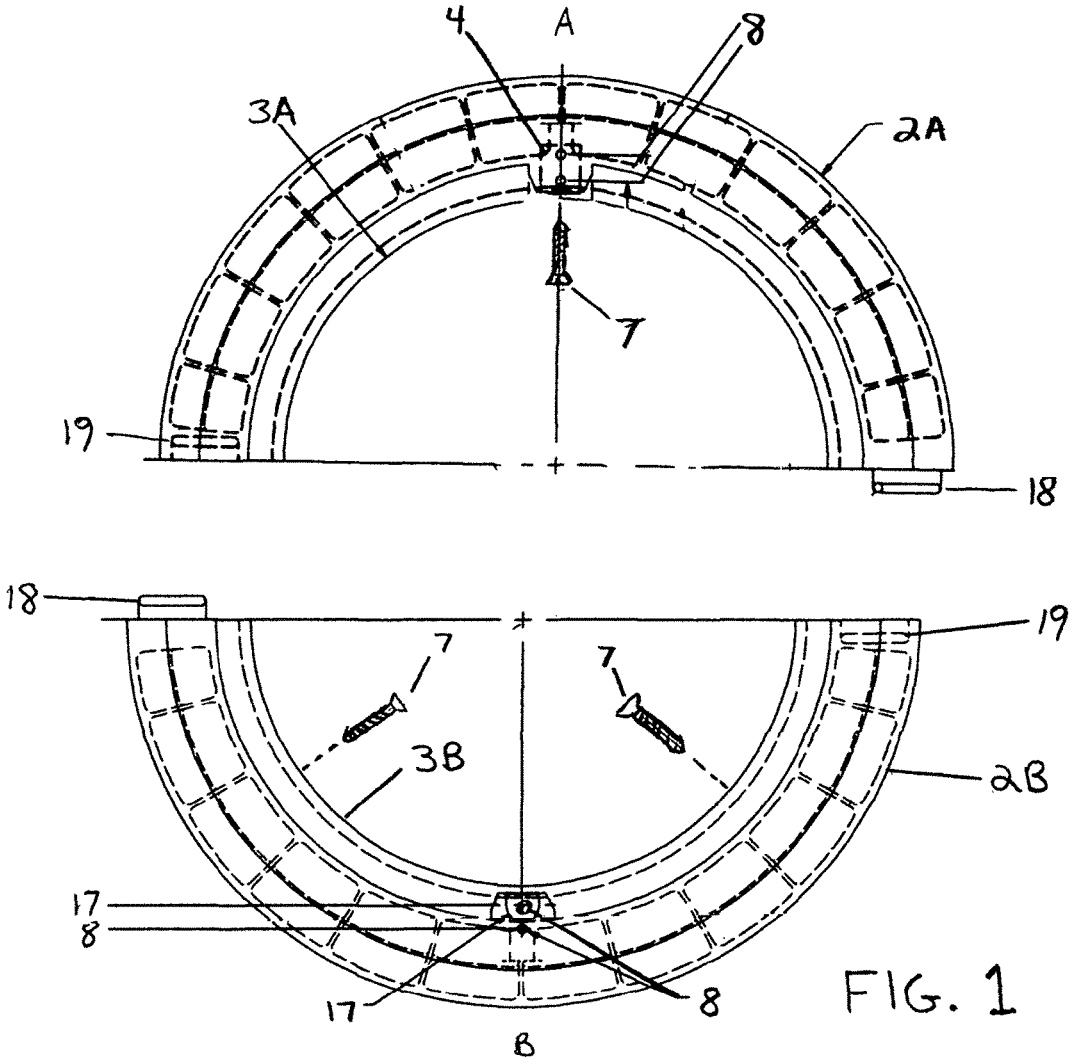
FIG. 1 is a transparent front view of the universal pool light ring adapter shown as two elements A and B unconnected.

In the descriptions which follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
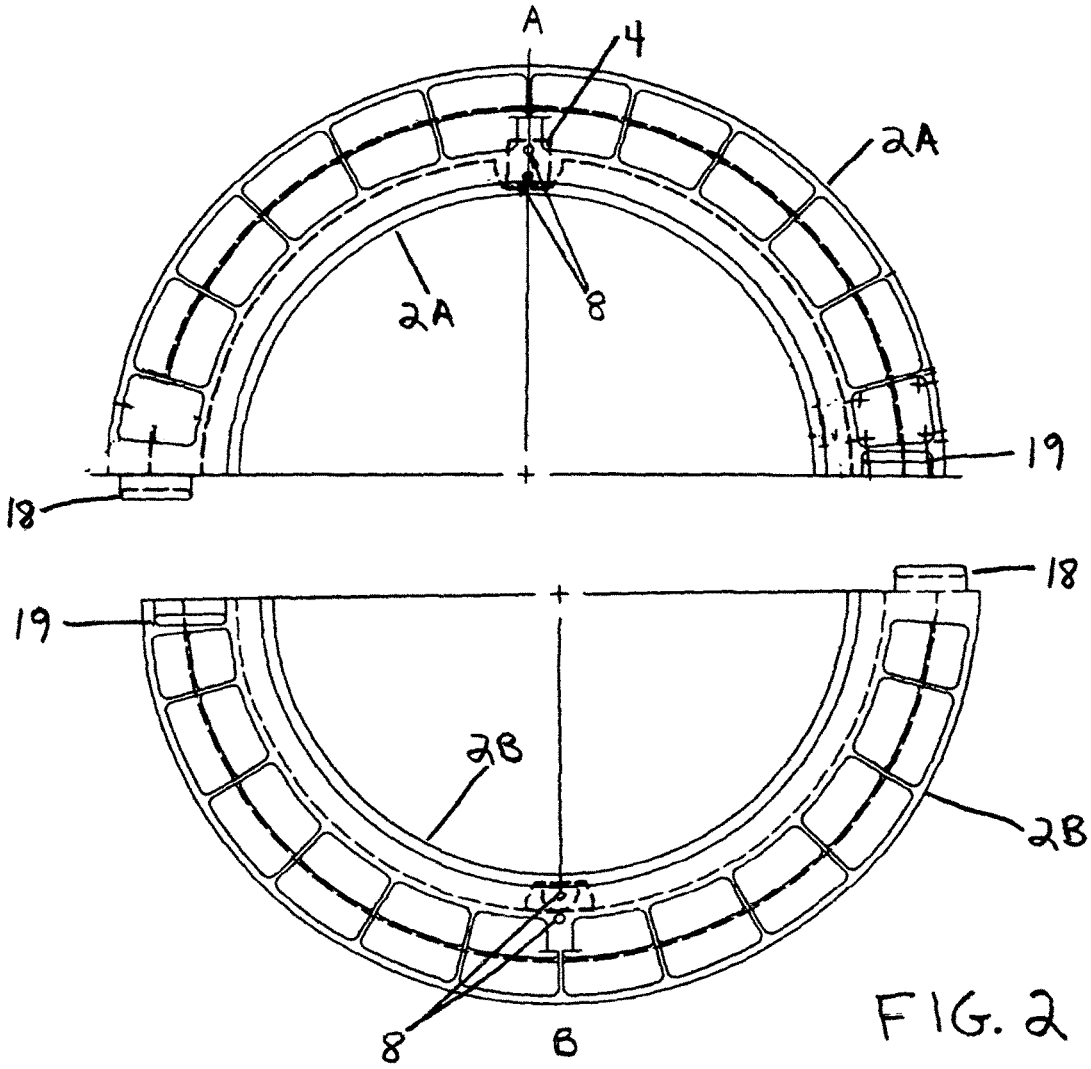
FIG. 2 is a transparent rear view of the universal pool light adapter ring shown as two elements A and B unconnected.
Figure 3:
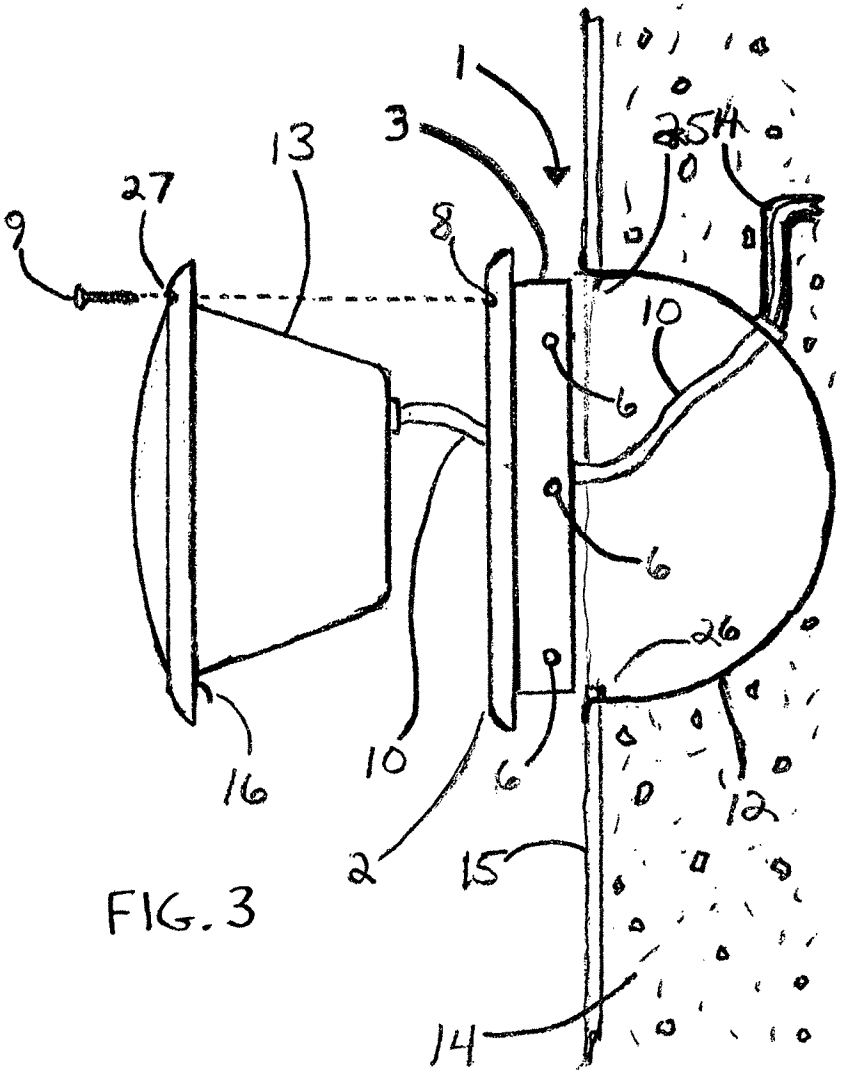
FIG. 3 is a sectional view depicting a universal light ring adapter inline to be installed between a pool light and a pool light niche.
Figure 4:
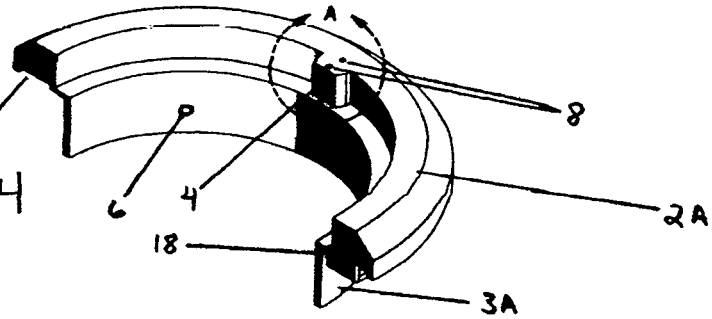
FIG. 4 is a perspective view of the universal pool light ring adapter A half.
Figure 5:
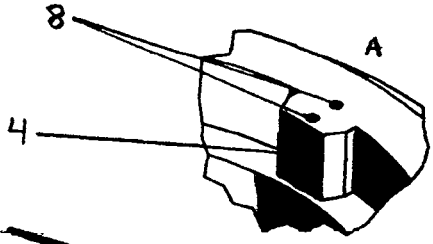
FIG. 5 is a perspective Detail of the A half of the universal light ring adapter detailing the lug.
Figure 6:
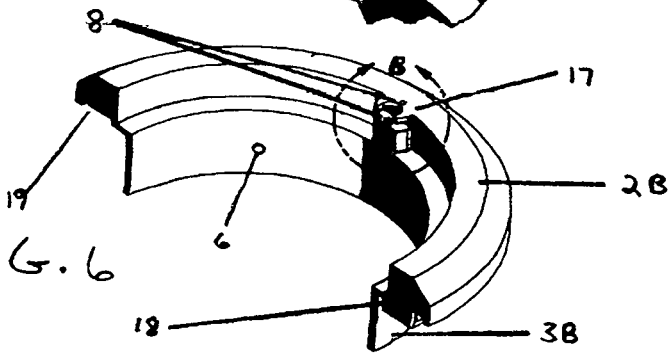
FIG. 6 is a perspective view of the universal light ring adapter B half.
Figure 7:
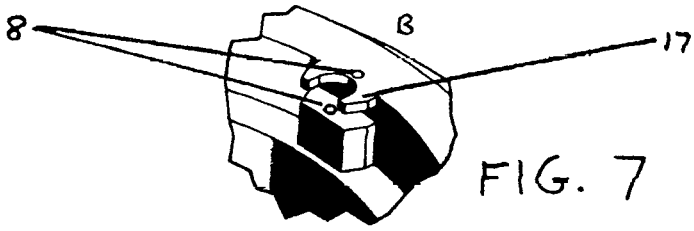
FIG. 7 is a perspective Detail of the B half of the universal light ring adapter detailing the mounting tab.
Figure 8:
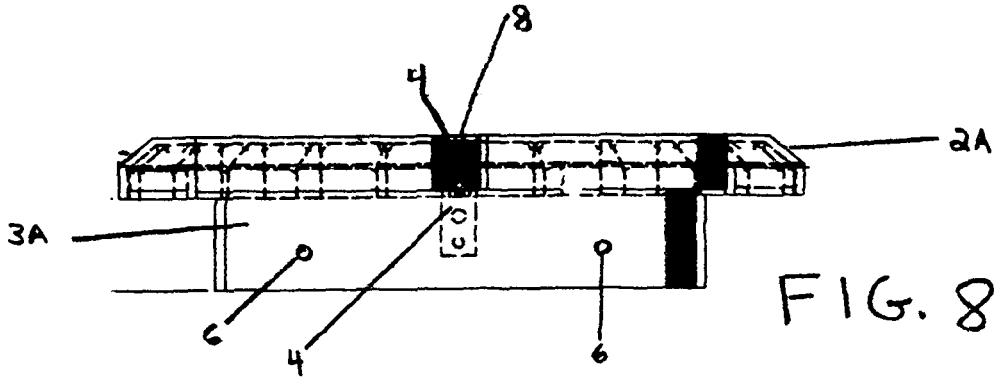
FIG. 8 is a transparent A side view of the universal light ring adapter showing the grounding element.
Figure 9:
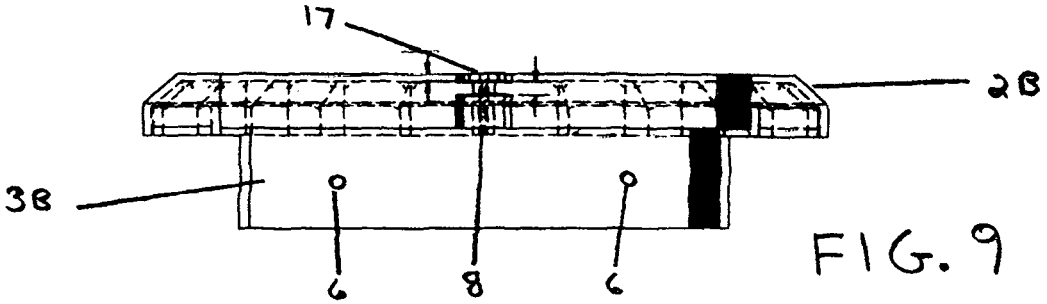
FIG. 9 is a transparent B side view of the universal light ring adapter showing the mounting tab.
Figure 10:
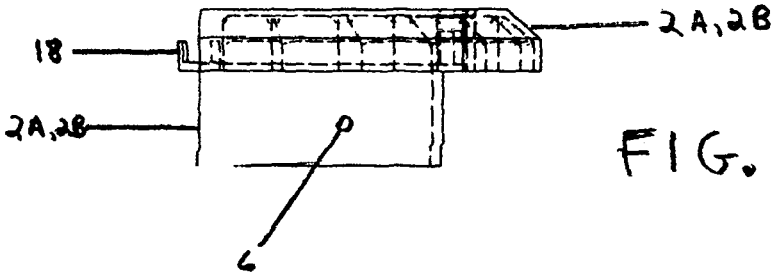
FIG. 10 is a transparent side view of the universal light ring adapter showing the interlocking tab which is present on A and B.

Various elements, features and benefits of the embodiments on the present invention will be more apparent with regard to the following description in conjunction with the included drawings. Those skilled in the art that the described embodiments of the present invention included herein are illustrative only and not limiting, and are presented in the way of example only. The features represented in this description may only be substituted with alternate features serving same or similar purposes, unless otherwise expressed. Therefore, other embodiments of modifications thereof are contemplated as falling within the scope of the present invention defined herein and equivalents thereto. Presently disclosed embodiments, as well as features and properties thereof, are directed to provide an adapter for a pool light ring 1 and method of installation. It should also become apparent from reviewing the drawings and descriptions, exemplary embodiments may allow user to easily secure the universal swimming pool light ring adapter 1. A person of ordinary skill in the art will recognize the embodiments of the universal swimming pool light ring adapter 1. In referring to the drawings of the invention of the universal swimming pool light adapter ring 1:

FIGS. 1-10 depict the present invention and its preferred embodiments. Often times a pool or spa light 13 will disconnect from its mounting within a light niche 12 for various reasons. Sometimes the single point screw 9 will corrode and break off, or the existing mounting tab 25 that retains the light mounting screw 9 will corrode and break off. Often the lower niche retaining tab 26 can snap off, leaving a situation where by the light fixture 13 cannot be remounted to the niche 12. Other situations may also arise, such as when installing a new light fixture 13 it becomes apparent that the new fixture 13 is simply not compatible with the existing niche 12. The mounting tabs 26, 17 just may not be in an orientation that allows for connection or the screw holes 27, 25 don't line up to allow a centered installation. Other such light rings for repairing such situations often are not effective. In order to install other light rings, the existing light fixture 13 may have to be removed and reinstalled after, or existing light fixture 13 has to be disassembled to facilitate installation and then reassembled afterwards. In some cases, certain brand light fixtures 13, such as a sealed beam light, are paired within a shallow light niche 12, and new replacement fixture 13 are too deep to be installed within the depth of the existing niche 12. The present invention solves most of the problems that could confront an installer or repair technician. Installation of the invention of the universal swimming pool light ring adapter 1 is started by connecting the preferred embodiment of the two element ring 2A, 2B around the light fixture cord 10 by simply pressing the two A and B halves together, engaging the adapter face ring mounting tabs 18 into the adapter face ring mounting slots 19. The adapter ring 1 is positioned into the existing light niche 12 and secured by means of the preferred embodiment of a plurality of screws 7 that are located thru threaded holes 6 in the adapter mounting ring 3 to create pressure points between the niche walls 12 and the adapter mounting ring 3. In order to achieve electrical grounding, one screw 7 must intersect with a grounding strap 4 molded within the A side of the adapter 1, in which the grounding strap 4 is "L" shaped so to be in both the horizontal and the vertical plane of the adapter 1. When the light screw 9 is engaged, it intersects with the face ring 2A plane thus contacting thru the ground strap 4, and then possessing an adapter mounting hole 6 by which the grounding strap 4 intersects as well, the adapter mounting screw 7 further intersects the grounding strap 4, transferring the ground from the fixture mounting screw 9 thru to the adapters mounting ring screw 7. The mounting ring screw 7 should contact the grounding bar of the niche 12 or if the niche 12 is made of stainless steel it should contact the stainless steel body of the niche 12, thus transferring an electric ground.

Once secure, the light fixture 13 is set onto the face ring 2 of the adapter 1 by interlocking the fixture mounting tab 16 of the light fixture 13 using the adapter mounting tab 17 on the B side of the adapter ring, and then mechanically fastening the pool light fixture 13 to the A section of the adapter 1A by engaging the light screw 9 thru the light fixture 13 and into the appropriate screw hole 8 of the A section of the adapter 1A. In some cases, a light fixture 13 may have two mounting screws 8 at opposing ends. The adapter 1 has the preferred embodiment of secondary mounting holes 8 on opposing sides to accommodate this possibility. It should be apparent to a person skilled in the art that the preferred embodiments of the present invention create a much more effective means of repairing an existing damaged pool light niche 12.

Various changes and modifications may be made within the scope of this invention and will be apparent to anyone of moderate skill in the art. It is implied within the preferred embodiments expressed that there are obvious alternative methods of engagement of a two element ring, such as, mechanical fastening or alternative click engagement systems of the like, and that such are included in the present invention. Any such changes and modifications would be considered within the scope and present art of this invention, as defined in the claims and descriptions appended hereto.

The invention claimed is:

1. A universal swimming pool light adapter ring for mounting a pool or spa light to a swimming pool light niche comprising:

a face ring comprised of first and second interlocking ring elements, the first and second interlocking ring elements each having two opposed ends wherein the first interlocking ring element includes a male tab on one opposing end and a female locking slot on the other opposing end and the second interlocking ring element includes a male tab on one opposing end and a female locking slot on the other opposing end;

two female thread points located at a respective center of each of the first and second interlocking ring elements for the purpose of mounting a light fixture;

a tab located in the center of only one of the first and second interlocking ring elements;

a mounting ring, comprised of two mounting ring elements, attached perpendicularly to the face ring, each mounting ring element including a plurality of threaded mounting holes in each mounting ring element, respectively;

at least one threaded mounting screw positioned in a selected mounting hole of the plurality of threaded mounting holes so that the mounting screw translates through the selected mounting hole radially outward from a center of the face ring so as to contact the walls of the swimming pool light niche, thus securing the swimming pool light adapter ring in place; and an electrically conductive grounding element molded into the center arc of one of the first and second interlocking ring elements.

2. The universal swimming pool light adapter ring of claim 1 wherein each of the first and second interlocking ring elements of the face ring include a recessed pocket on one end and an extruded tab on the opposing end.

3. The universal swimming pool light adapter ring of claim 2 wherein the said recessed posket from on of the first and second interlocking ring elements and the said extruded tab from the other of the first and second interlocking ring elements, mate snugly to form a secure connection to create one circular face ring.

4. The universal swimming pool light adapter ring of claim 1 wherein the said grounding element is L-shaped so that one side of the grounding element is in the same plane as the face ring and the other side of the grounding element is in the same plane as the mounting ring.

5. The universal swimming pool light adapter ring of claim 4 wherein the said grounding element is located so that the two threaded points of the face ring intersect on one plane with two threaded points on the grounding element to allow translation of a screw for the purpose of mounting a light fixture; and on another plane, a further threaded hole is located on the grounding element so that the further threaded hole may intersect with a mounting screw and mounting hole of the mounting ring to create a path of conductivity from the fixture screw to the mounting screw.

6. The universal swimming pool light adapter ring of claim 1 wherein the said face fing is of a dimensional profile that extends a sealed beam niche allowing any traditional size pool light fixture to be retrofitted into the extended sealed beam niche.

7. The universal swimming pool light adapter ring of claim 1 wherein the universal swimming pool light adapter ring is constructed of plastic.

8. The universal swimming pool light adapter ring of claim 1 wherein the universal swimming pool light adapter ring is constructed of a metal that is resistive of rust and corrosion.

9. The universal swimming pool light adapter ring of claim 1 wherein, the male tab of the one opposing end of the first interlocking ring element and the female locking slot of the one opposing end of the second interlocking ring element overlap with one another to form a clip fastening the first interlocking ring element and the second interlocking ring elements together; and the female tab of the other opposing end of the first interlocking ring element and the male locking slot of the other opposing end of the second interlocking ring element overlap with one another to form a clip fastening the first interlocking ring element and the second interlocking ring elements together.

10. The universal swimming pool light adapter ring of claim 1 wherein a profile of the said face ring is dimensioned so that the face ring is configured to extend out from a pool wall or niche to enable a standard size pool fixture to be installed into a sealed beam light niche or other shallow niches.

11. The universal swimming pool light adapter ring according to any one of claims 1-8 and 9, wherein the universal swimming pool light adapter ring is sized to be inserted into a pre-existing spa light niche.

* * * * *